United States Patent [19]

Iggulden et al.

[11] Patent Number: 5,054,945

[45] Date of Patent: Oct. 8, 1991

[54] COMPACT WINDOW-WASHING BOTTLE WITH PROTECTED SPONGE AND SQUEEGEE

[76] Inventors: Jerry R. Iggulden, 21600 Cleardale St., Santa Clarita, Calif. 91321; Donald A. Streck, 832 Country Dr., Ojai, Calif. 93023

[21] Appl. No.: 651,772

[22] Filed: Feb. 7, 1991

[51] Int. Cl.[5] ..... A47L 1/08

[52] U.S. Cl. ..... 401/23; 401/25; 401/37; 401/139; 401/186

[58] Field of Search ..... 401/183, 186, 23, 37, 401/190, 16, 22, 139, 25, 27

[56] References Cited

U.S. PATENT DOCUMENTS

| | | | |
|---|---|---|---|
| 287,254 | 10/1883 | Deeds et al. | 401/23 |
| 2,859,463 | 11/1958 | Hirsch | 401/139 |
| 2,986,762 | 6/1961 | Webb | 401/16 X |
| 3,455,638 | 7/1969 | Braswell | 401/23 |
| 3,837,747 | 9/1974 | Seymore | 401/25 |
| 4,776,716 | 10/1988 | Huang | 401/27 X |

*Primary Examiner*—Steven A. Bratlie

*Attorney, Agent, or Firm*—Donald A. Streck

[57] ABSTRACT

This is a bottle for containing a window-washing solution and having a sponge and a squeegee blade mounted vertially thereon along the side of the bottle. The sponge communicates with the interior of the bottle through an anti-leak valve contained in a button protrusion in the sidewall of the bottle overwhich a plastic member carrying the sponge and squeegee blade is snapped. A protective cover also snaps onto the bottle and covers the sponge and squeegee blade to protect them from deformation and damage during storage. The bottle with sponge, squeegee blade and protective cover in place provides a small profile for storage in the glove compartment of an automobile or the like.

17 Claims, 2 Drawing Sheets

COMPACT WINDOW-WASHING BOTTLE WITH PROTECTED SPONGE AND SQUEEGEE

BACKGROUND OF THE INVENTION

This invention relates to window-washing apparatus and, more particularly, to easily and safely stored apparatus for cleaning glass comprising, a bottle of a resiliently squeezable material, the bottle having a first opening therein in a wall thereof through which liquid cleaning solution can be poured into the bottle and a second opening therein in a wall thereof through which liquid cleaning solution contained therein can be forced out by squeezing the bottle, the first opening being contained within a threaded neck in an end wall of the bottle; the second opening being contained within a button protrusion in a sidewall of the bottle; sealing means for removably sealing the first opening, the sealing means comprising a threaded cap sized to theadedly engage the threaded neck; valve means disposed in the second opening for allowing liquid cleaning solution contained in the bottle to exit the bottle through the second opening only under pressure created by squeezing the bottle; an elongated plastic member having a sponge disposed along one edge thereof and a squeegee blade disposed along another edge thereof, the plastic member having at least one bore therein communicating between a place of attachment and the sponge; attaching means for attaching the plastic member to the bottle with the place of attachment disposed adjacent the valve means to received liquid cleaning solution emerging therefrom and with the plastic member and the sponge and squeegee blade thereof aligned with a longitudinal axis of the bottle, the attaching means comprising a socket in the plastic member sized and shaped to sealably mate with the button protrusion; a protective shield disposed over the sponge and the squeegee blade; and, clip means extending from the protective shield on opposite longitudinal edges thereof for removeably holding the protective shield onto the bottle.

The washing of windows is a chore that most people hate because of the inconvenience involved. In large commercial buildings the washing of windows is a never-ending task. Fortunately, it is easy in such applications to employ large tools that do the job quickly and efficiently. A bucket of water coupled with a brush and squeegee has long been the preferred approach.

In smaller applications such as around the home or the windows of an automobile, it is generally not practical to employ such an approach—particularly on interior windows. Automobiles, in particular, pose a problem when designing equipment for window washing. It used to be that filling stations washed the windows of a patron's car when the car was being filled with gasoline. Such service disappeared along with checking the oil and the air pressure in the tires in favor of so-called "self-service" stations. In some self-service stations, there is still a bucket of water near the pumps along with a small, hand-held window cleaning device such as that depicted in FIGS. 1 and 2. There is a handle 10 for grasping on one end. On the other end, there is an elongated sponge 12 on one side and a squeegee blade 14 on the other side. The sponge 12 typically has a non-scratching cover on it to aid in removing stubborn spots on the glass. The user simply dips the sponge 12 and squeegee blade 14 into the bucket, rubs the sponge 12 over the glass to wet it and remove stuck-on objects such as bugs, and then uses the squeegee blade 14 to wipe off the water in the typical manner. The big problem is that more often than not, the station does not provide such service, someone has removed the cleaning device from the bucket, the bucket is empty, or the cleaning device is in such poor condition from frequent use and mis-use that it can not be used effectively to clean glass. Moreover, it is not uncommon for the windshield in particular to become quite dirty long before the next trip to the gas station is due. To aid in this problem, some people buy a device like that of FIGS. 1 and 2 and keep it in their car. All too often, however, there is no source of water when cleaning is required or the device becomes mis-shapen and virtually useless from having packages, and the like piled upon it where it has been thrown onto the back seat or floor following its last use. Of course, one can always store a bottle of spray window cleaner and a roll of paper towels in the car; but, that too is subject to the same damage and even greater space considerations.

In an attempt to solve the foregoing problems of window washing, the bottle 16 of FIG. 3 was introduced into the prior art. The bottle 16 is a standard plastic bottle filled with a windowcleaning solution and has a sponge 12 and a squeegee blade 14 mounted across the cap of the bottle so that the bottle 16 acts as the handle 10 of the above-described apparatus of FIGS. 1 and 2. A hole in the cap of the bottle 16 communicates between the inside of the bottle 16 and the sponge 12. By squeezing the bottle 16, a quantity of the cleaning solution is forced into the sponge 12 to be used in cleaning a window. Unfortunately, while filled with good intentions, the window-washing bottle 16 of FIG. 3 has too many problems to make it more than a temporary fad item. Sitting on a shelf, it does not have too many problems. One major problem, however, is that it is not much good sitting on a shelf. What is desired is something that can be put into the glove compartment of an automobile, for example. The cap of the bottle 16 is typically provided with a removeable sealing disk that covers the hole in the cap when the device is not in use. The constant removal and replacement of the disk is inconvenient; so, it is quite often removed the first time and discarded. In sitting on the shelf thereafter in its intended upright position, the cleaning solution slowly evaporates. In the more typical situation where the bottle 16 is laid on its side or is knocked over, the cleaning solution quickly evaporates through the saturated sponge. It also runs all over. In the case where the bottle 16 has been put into the glove compartment of an automobile, the contents are damaged by the liquid cleaning solution. This is rare, fortunately, only because the large T-shape presented by the bottle with the sponge 12 and squeegee blade 14 attached does not lend itself to fitting into the typical glove compartment of today's automobiles along with all the other items that are stored therein. Regardless of where it is stored, the user is quite likely to find that the sponge 12 has been flattened and the plastic of the squeegee blade 14 has been bent and dented so as to leave streaks the next time it is removed for use.

Wherefore, it is an object of this invention to provide a combined bottle, sponge and squeegee blade which is convenient to store and use.

It is another object of this invention to provide a combined bottle, sponge and squeegee blade which does not require the removal and replacement of sealing apparatus each time it is used.

It is yet another object of this invention to provide a combined bottle, sponge and squeegee blade which resists leaking of the cleaning solution stored therein.

It is still another object of this invention to provide a combined bottle, sponge and squeegee blade which resists damage to the sponge and squeegee blade during storage thereof between uses.

It is a further object of this invention to provide a combined bottle, sponge and squeegee blade which provides a small shape which is convenient to store in glove compartment and similar places between uses.

Other objects and benefits of the invention will become apparent from the detailed description which follows hereinafter when taken in conjunction with the drawing figures which accompany it.

SUMMARY

The foregoing objects have been achieved in glass cleaning apparatus according to the present invention comprising, a bottle of a resiliently squeezable material, the bottle having a first opening therein in a wall thereof through which liquid cleaning solution can be poured into the bottle and a second opening therein in a wall thereof through which liquid cleaning solution contained therein can be forced out by squeezing the bottle; sealing means for removably sealing the first opening; valve means disposed in the second opening for allowing liquid cleaning solution contained in the bottle to exit the bottle through the second opening only under pressure created by squeezing the bottle; an elongated plastic member having a sponge disposed along one edge thereof and a squeegee blade disposed along another edge thereof, the plastic member having at least one bore therein communicating between a place of attatchment and the sponge; and, attaching means for attaching the plastic member to the bottle with the place of attachment disposed adjacent the valve means to received liquid cleaning solution emerging therefrom and with the plastic member and the sponge and squeegee blade thereof aligned with a longitudinal axis of the bottle.

In the preferred embodiment, the first opening is contained within a threaded neck in an end wall of the bottle; and, the sealing means comprises a threaded cap sized to theadedly engage the threaded neck.

Further in the preferred embodiment, the second opening is contained within a button protrusion in a sidewall of the bottle; and, the attaching means comprises a socket in the plastic member sized and shaped to sealably mate with the button protrusion. Preferably, the button protrusion has a peripheral ridge therearound; and, the socket has an internal peripheral groove positioned to receive the peripheral ridge.

Also in the preferred embodiment, the second opening is a cylindrical bore; and, the valve means comprises a cylindrical duckbill valve press-fit into the cylindrical bore. Additionally, an exterior surface of the bottle includes indicia thereon for indicating quantities of a concentrated cleaning solution and water to be inserted into the bottle to create a preferred cleaning solution for use therewith.

For safety in storage, the preferred apparatus includes a protective shield disposed over the sponge and the squeegee blade; and, clip means for removeably holding the protective shield onto the bottle. Preferably, the protective shield is a unitary construction containing the clip means extending from the protective shield on opposite longitudinal edges thereof.

DESCRIPTION OF THE PREFERRED EMBODIMENT

Figure 1:
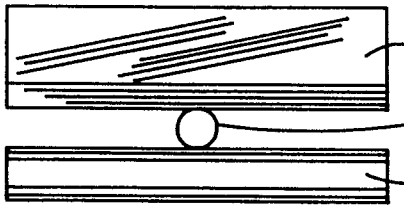
PRIOR ART FIG. 1
FIG. 1 is a top view of a prior art combination sponge and squeegee for washing windows.
Figure 2:
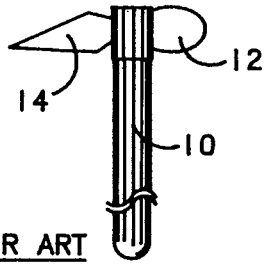
PRIOR ART FIG. 2
FIG. 2 is a side view of the apparatus of FIG. 1 mounted on a handle.
Figure 3:
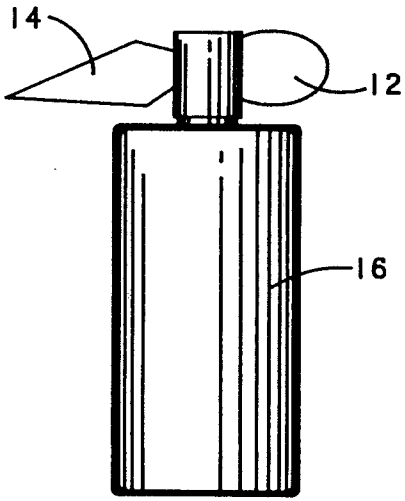
PRIOR ART FIG. 3
FIG. 3 is a side view of the apparatus of FIG. 1 mounted on the top of a bottle containing a window-washing solution.

The glass-washing apparatus of the present invention depicted in FIGS. 4 through 8 where it is generally indicated as 18. The apparatus 18 comprises a plastic bottle 16' having a sponge 12 and squeegee blade 14 vertically mounted along a side edge thereof. As will be seen shortly, the sponge 12 communicates with the interior of the bottle 16' and washing solution 20 contained therein through a valved opening in the sidewalls. The sponge 12 and squeegee blade 14 are carried by an elongated plastic member 22. The sponge 12 and squeegee blade 14 are of typical construction for such applications and, per se, form no part of the novelty of the invention. Moreover, they can be attached to the elongated plastic member 22 by any of several techniques well known in the art, a suitable adhesive being preferred for ease of manufacture and assembly. The plastic member 22 lies along the exterior surface of the sidewall 24 of the bottle 16' and is supported thereby, but not attached thereto. If desired, however, the plastic of the bottle 16' and the member 22 could be provided with interacting protrusions and indentations which more firmly attach the plastic member 22 to the bottle 16'.

In this regard, the preferred approach for sale and use of this invention is to initially sell the bottle 16' and the plastic member 22 containing the sponge 12 and squeegee blade 14 together but unassembled along with a quantity of cleaning solution concentrate. Upon purchase, the user will insert the valve (to be described shortly) and then non-removeably snap the plastic member 22 onto the bottle 16'. The bottle will then be filled with a mixture of the concentrate and water to make it ready for use. Thereafter, the solution need only be refilled as necessary. To protect the squeegee blade 14 and sponge 12 during storage, the protective cover 26 is snapped around the bottle 16' and over the squeegee blade 14 and sponge 12. As can be seen from the drawing of FIG. 7 in particular, the protective cover 26 is slightly larger in degrees than semi-cylindrical and made of a plastic such as polyethylene so as to easy snap onto and off of the bottle 16'.

Figure 8:
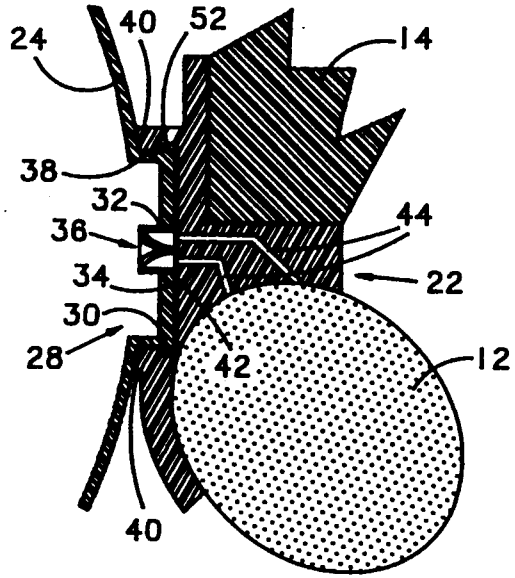
FIG. 8 is an enlarged, cutaway drawing of the apparatus of the present invention at the point where the sponge and squeegee are attached to the side of bottle and depicting the valve disposed therein.
Figure 5:
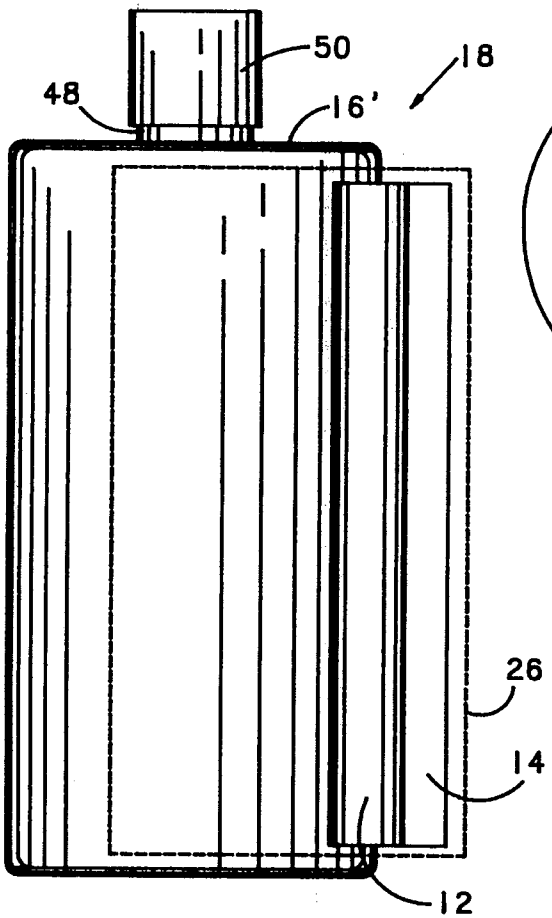
FIG. 5 is a side view of the window-washing bottle of the present invention from a viewing angle showing the vertical sponge attached thereto with particularity.

Turning now with particularity to FIG. 8, the method of attachment of the plastic member 22 to the bottle 16' which forms the major point of novelty of this invention will now be described in detail. In the preferred embodiment as shown and described, the sidewall 24 of the bottle 16' has a button protrusion 28 molded therein. The protrusion 28 is circular in cross section and has a peripheral ridge 30 along the surface thereof. There is a cylindrical bore 32 through the center of the circular outer surface 34 of the protrusion 28. A small, cylindrical duckbill valve 36 is press-fit into the bore 32 so as to maintain liquid within the bottle 16' from leaking and evaporating. The liquid (i.e. the washing solution 20) is ejected through the valve 36 only when the bottle 16' is firmly squeezed. As stated earlier herein, it is intended that the valve 36 be packaged along with the plastic member 22 disassembled from the bottle 16'. As will be noted from the drawing of FIG. 8, the plastic member 22 has a socket 38 formed therein sized and shaped to sealably snap fit with the button protrusion 28. The socket 38 includes an internal groove 52 positioned to receive the peripheral ridge 30 helping to seal and retain the mating relationship between the two parts. Thus, to assemble the apparatus of this invention for use following initial purchase thereof, the user first presses the valve 36 into the bore 32 and then snaps the socket 38 of the plastic member 22 over the protrusion 28 with the plastic member 22 disposed longitudinally aligned with the bottle 16' and the support bars 40 lying along the outer surface of the sidewall 24. Note that in the preferred embodiment, the valve 36 has a peripheral ridge 42 at its outer end to prevent its being inserted backwards and thus rendering the apparatus inoperative.

The plastic member 22 has a plurality of small bores 44 therein communicating between the socket 38 adjacent the valve 36 and the sponge 12. Thus, when the bottle 16' is squeezed, a quantity of the cleaning solution 20 is forced out of the valve 36 and into the bores 44 through which it travels to wet the sponge for glass cleaning purposes.

Figure 4:
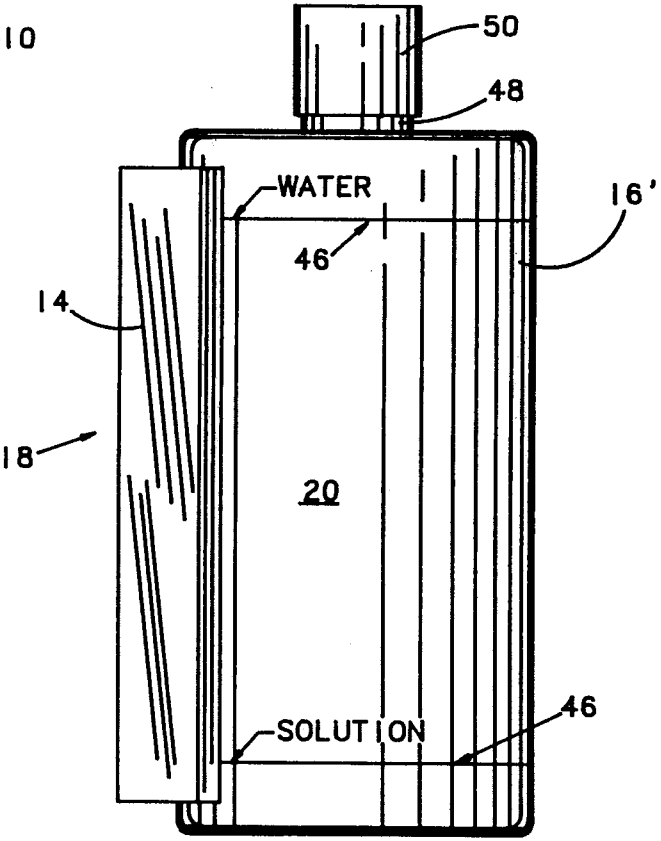
FIG. 4 is a side view of the window-washing bottle of the present invention from a viewing angle showing the squeegee attached thereto with particularity.
Figure 7:
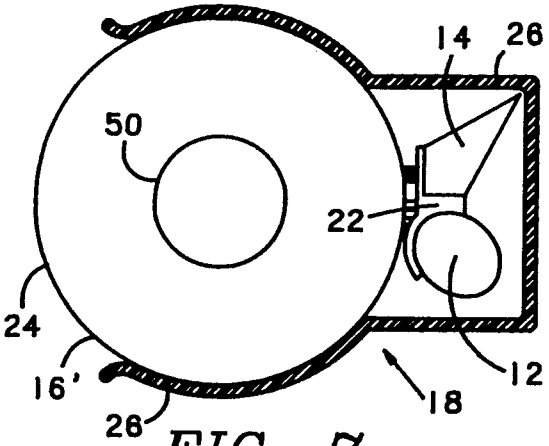
FIG. 7 is a top view of the window-washing bottle of the present invention with the protective cover for the sponge and squeegee attached.
Figure 6:
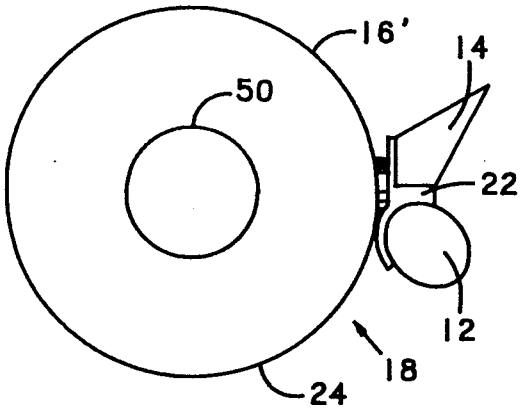
FIG. 6 is a top view of the window-washing bottle of the present invention with the protective cover for the sponge and squeegee removed.

As depicted in FIG. 4, in the preferred embodiment which is intended for refilling with a quantity of concentrated cleaning solution and water (so as to make storage in a glove compartment, for example, much easier), the exterior surface of the sidewall 24 is suitable marked with indicia 46 showing the most desirable mixture of concentrate and water with which to fill the bottle 16'. The filling, of course, takes place through the top of the bottle 16' which is provided with a standard threaded neck opening 48 and a removable threaded cap 50 therefor.

Thus, it can be seen that the present invention has truly met its desired objects by providing a liquid-storing tool for cleaning glass which is small and convenient for storing in a glove compartment or the like while preventing leakage and protecting the glass-cleaning components from damage during storage.

Wherefore, having thus described our invention, we claim:

1. Glass cleaning apparatus comprising:

a) a bottle of a resiliently squeezable material, said bottle having a first opening therein in a wall thereof through which liquid cleaning solution can be poured into said bottle and a second opening therein in a wall thereof through which liquid cleaning solution contained therein can be forced out by squeezing said bottle;

b) sealing means for removably sealing said first opening;

c) valve means disposed in said second opening for allowing liquid cleaning solution contained in said bottle to exit said bottle through said second opening only under pressure created by squeezing said bottle;

d) an elongated plastic member having a sponge disposed along one edge thereof and a squeegee blade disposed along another edge thereof, said plastic member having at least one bore therein communicating between a place of attachment and said sponge; and, e) attaching means for attaching said plastic member to said bottle with said place of attachment disposed adjacent said valve means to received liquid cleaning solution emerging therefrom and with said plastic member and said sponge and squeegee blade thereof aligned with a longitudinal axis of said bottle.

2. The glass cleaning apparatus of claim 1 wherein:

a) said first opening is contained within a threaded neck in an end wall of said bottle; and, b) said sealing means comprises a threaded cap sized to theadedly engage said threaded neck.

3. The glass cleaning apparatus of claim 1 wherein:

a) said second opening is contained within a button protrusion in a sidewall of said bottle; and, b) said attaching means comprises a socket in said plastic member sized and shaped to sealably mate with said button protrusion.

4. The glass cleaning apparatus of claim 3 wherein:

a) said button protrusion has a peripheral ridge thereround; and, b) said socket has an internal peripheral groove positioned to receive said peripheral ridge.

5. The glass cleaning apparatus of claim 1 wherein:

a) said second opening is a cylindrical bore; and, b) said valve means comprises a cylindrical duckbill valve press-fit into said cylindrical bore.

6. The glass cleaning apparatus of claim 1 wherein:

an exterior surface of said bottle includes indicia thereon for indicating quantities of a concentrated cleaning solution and water to be inserted into said bottle to create a preferred cleaning solution for use therewith.

7. The glass cleaning apparatus of claim 1 and additionally comprising:

a) a protective shield disposed over said sponge and said squeegee blade; and, b) clip means for removeably holding said protective shield onto said bottle.

8. The glass cleaning apparatus of claim 7 wherein: said protective shield is a unitary construction containing said clip means extending from said protective shield on opposite longitudinal edges thereof.

9. Glass cleaning apparatus comprising:

a) a bottle of a resiliently squeezable material, said bottle having a first opening therein in a wall thereof through which liquid cleaning solution can be poured into said bottle and a second opening therein in a wall thereof through which liquid cleaning solution contained therein can be forced out by squeezing said bottle, said first opening being contained within a threaded neck in an end wall of said bottle, said second opening being contained within a button protrusion in a sidewall of said bottle;

b) sealing means for removably sealing said first opening, said sealing means comprising a threaded cap sized to theadedly engage said threaded neck;

c) valve means disposed in said second opening for allowing liquid cleaning solution contained in said bottle to exit said bottle through said second opening only under pressure created by squeezing said bottle;

d) an elongated plastic member having a sponge disposed along one edge thereof and a squeegee blade disposed along another edge thereof, said plastic member having at least one bore therein communicating between a place of attachment and said sponge; and, e) attaching means for attaching said plastic member to said bottle with said place of attachment disposed adjacent said valve means to received liquid cleaning solution emerging therefrom and with said plastic member and said sponge and squeegee blade thereof aligned with a longitudinal axis of said bottle, said attaching means comprising a socket in said plastic member sized and shaped to sealably mate with said button protrusion.

10. The glass cleaning apparatus of claim 9 wherein:

a) said button protrusion has a peripheral ridge therearound; and, b) said socket has an internal peripheral groove positioned to receive said peripheral ridge.

11. The glass cleaning apparatus of claim 9 wherein:

a) said second opening is a cylindrical bore; and, b) said valve means comprises a cylindrical duckbill valve press-fit into said cylindrical bore.

12. The glass cleaning apparatus of claim 9 wherein: an exterior surface of said bottle includes indicia thereon for indicating quantities of a concentrated cleaning solution and water to be inserted into said bottle to create a preferred cleaning solution for use therewith.

13. The glass cleaning apparatus of claim 9 and additionally comprising:

a) a protective shield disposed over said sponge and said squeegee blade; and, b) clip means extending from said protective shield on opposite longitudinal edges thereof for removeably holding said protective shield onto said bottle.

14. Easily and safely stored apparatus for cleaning glass comprising:

a) a bottle of a resiliently squeezable material, said bottle having a first opening therein in a wall thereof through which liquid cleaning solution can be poured into said bottle and a second opening therein in a wall thereof through which liquid cleaning solution contained therein can be forced out by squeezing said bottle, said first opening being contained within a threaded neck in an end wall of said bottle, said second opening being contained within a button protrusion in a sidewall of said bottle;

b) sealing means for removably sealing said first opening, said sealing means comprising a threaded cap sized to theadedly engage said threaded neck;

c) valve means disposed in said second opening for allowing liquid cleaning solution contained in said bottle to exit said bottle through said second opening only under pressure created by squeezing said bottle;

d) an elongated plastic member having a sponge disposed along one edge thereof and a squeegee blade disposed along another edge thereof, said plastic member having at least one bore therein communicating between a place of attachment and said sponge;

e) attaching means for attaching said plastic member to said bottle with said place of attachment disposed adjacent said valve means to received liquid cleaning solution emerging therefrom and with said plastic member and said sponge and squeegee blade thereof aligned with a longitudinal axis of said bottle, said attaching means comprising a socket in said plastic member sized and shaped to sealably mate with said button protrusion;

f) a protective shield disposed over said sponge and said squeegee blade; and, g) clip means extending from said protective shield on opposite longitudinal edges thereof for removeably holding said protective shield onto said bottle.

15. The glass cleaning apparatus of claim 14 wherein:

a) said button protrusion has a peripheral ridge therearound; and, b) said socket has an internal peripheral groove positioned to receive said peripheral ridge.

16. The glass cleaning apparatus of claim 14 wherein:

a) said second opening is a cylindrical bore; and, b) said valve means comprises a cylindrical duckbill valve press-fit into said cylindrical bore.

17. The glass cleaning apparatus of claim 14 wherein: an exterior surface of said bottle includes indicia thereon for indicating quantities of a concentrated cleaning solution and water to be inserted into said bottle to create a preferred cleaning solution for use therewith.

* * * * *